US010954657B2

(12) United States Patent
Hornback et al.

(10) Patent No.: US 10,954,657 B2
(45) Date of Patent: Mar. 23, 2021

(54) METHODS, SYSTEMS, AND DEVICES FOR SECURING AND SUPPORTING A SINK

(71) Applicant: Accurtech, Inc., Valparaiso, IN (US)

(72) Inventors: Eric T. L. Hornback, Valparaiso, IN (US); Jeannine M. Hornback, Valparaiso, IN (US)

(73) Assignee: Accurtech Inc., Valparaiso, IN (US)

( * ) Notice: Subject to any disclaimer, the term of this patent is extended or adjusted under 35 U.S.C. 154(b) by 0 days.

(21) Appl. No.: 15/944,462

(22) Filed: Apr. 3, 2018

(65) Prior Publication Data

US 2018/0355596 A1 Dec. 13, 2018

Related U.S. Application Data

(60) Provisional application No. 62/480,620, filed on Apr. 3, 2017.

(51) Int. Cl.
*E03C 1/322* (2006.01)
*E03C 1/33* (2006.01)

(52) U.S. Cl.
CPC ..... *E03C 1/33* (2013.01); *E03C 1/322* (2013.01)

(58) Field of Classification Search
CPC . A47K 1/04–1/05; A47K 1/08; E03C 1/0401; E03C 1/042; E03C 1/18; E03C 1/181; E03C 1/32; E03C 1/322; E03C 1/324; E03C 1/33; E03D 11/14
USPC ..... 4/647–648
See application file for complete search history.

(56) References Cited

U.S. PATENT DOCUMENTS

| | | | | | |
|---|---|---|---|---|---|
| 784,962 | A * | 3/1905 | Reed | E03C 1/322 | 4/647 |
| 906,247 | A * | 12/1908 | Mahoney | E03C 1/322 | 4/647 |
| 1,035,457 | A * | 8/1912 | Madden | E03C 1/322 | 4/648 |
| 1,922,345 | A * | 8/1933 | Bauch | A47K 5/02 | 248/222.51 |
| 2,361,604 | A * | 10/1944 | Coordes | E03C 1/322 | 4/647 |
| 6,401,275 | B1 * | 6/2002 | Garner | A47J 47/20 | 4/658 |
| 2007/0075214 | A1 * | 4/2007 | Hong | A47K 1/05 | 248/690 |
| 2009/0250120 | A1 * | 10/2009 | Robbins | E03C 1/021 | 137/360 |

FOREIGN PATENT DOCUMENTS

| | | | | |
|---|---|---|---|---|
| FR | 436869 | * | 4/1912 | E03C 1/322 |

* cited by examiner

*Primary Examiner* — David P Angwin
*Assistant Examiner* — Nicholas A Ros
(74) *Attorney, Agent, or Firm* — Hartman Global IP Law; Gary M. Hartman; Domenica N. S. Hartman

(57) ABSTRACT

Methods, systems, and hardware suitable for mounting a sink to a mounting structure. A mounting device for use in such methods and systems secures or supports a wall-mounted sink to a mounting structure at or adjacent an upper extremity of the sink and/or at a faucet-mounting hole of the sink.

10 Claims, 9 Drawing Sheets

METHODS, SYSTEMS, AND DEVICES FOR SECURING AND SUPPORTING A SINK

CROSS REFERENCE TO RELATED APPLICATIONS

This application claims the benefit of U.S. Provisional Application No. 61/480,620, filed Apr. 3, 2017, the contents of which are incorporated herein by reference.

BACKGROUND OF THE INVENTION

The present invention generally relates to methods, systems, and hardware for mounting and supporting sinks configured to be mounted to a wall or other substantially vertically-oriented support structure. The invention particularly relates to methods, systems, and hardware for mounting and supporting a wall-mounted sink to counteract and distribute forces that otherwise may cause the sink to pull away from a wall and/or cause the sink to separate from an undermount sink support conventionally used to secure wall-mounted sinks to walls.

As used herein, a "wall-mounted sink" refers to a sink that is primarily if not exclusively supported by a substantially vertically-oriented mounting structure, typically a wall. Conventional supporting methods and systems used with wall-mounted sinks include the use of undermount sink supports, such as brackets, hangers, and bolts that may engage grooves or holes in the sink. These mounting techniques result in the tendency for the sink to pivot away from its mounting structure about the sink's pivot axis, which as used herein is defined as a horizontal axis about which the weight of the sink causes the sink to pivot downward relative to its mounting structure, for example, about the lowermost extent of the sink in contact with the mounting structure. As the sink gradually pulls away from its mounting structure, a gap is created between the sink and structure that detracts from the appearance of the sink and requires repair, such as by caulking. In more extreme cases, a sink may completely slip off its support due to forces exerted on the sink (including but not limited to the weight of the sink).

Therefore, it would be desirable if means were provided that was capable of counteracting and distributing forces that act to pull and possibly completely separate a wall-mounted sink from its mounting structure.

BRIEF DESCRIPTION OF THE INVENTION

The present invention provides methods, systems, and hardware suitable for mounting a sink to a structure.

According to one aspect of the invention, a mounting device is provided for securing or supporting a wall-mounted sink to a mounting structure at or near an upper extremity of the sink.

According to another aspect of the invention, a mounting device is provided for securing or supporting a sink to a mounting structure, the device comprising means for securing to faucet-mounting holes in the sink.

According to yet another aspect of the invention, a mounting device is provided for securing or supporting a sink to a mounting structure by means of interlocking the sink between the device and an undermount sink support of the sink.

Other aspects of the invention include methods of using a mounting device comprising elements as described above.

Technical aspects of the mounting devices described above preferably include the ability to counteract and distribute forces that act to pull and possibly completely separate a wall-mounted sink from its mounting structure.

Other aspects and advantages of this invention will be appreciated from the following detailed description.

DETAILED DESCRIPTION OF THE INVENTION

Figure 1:
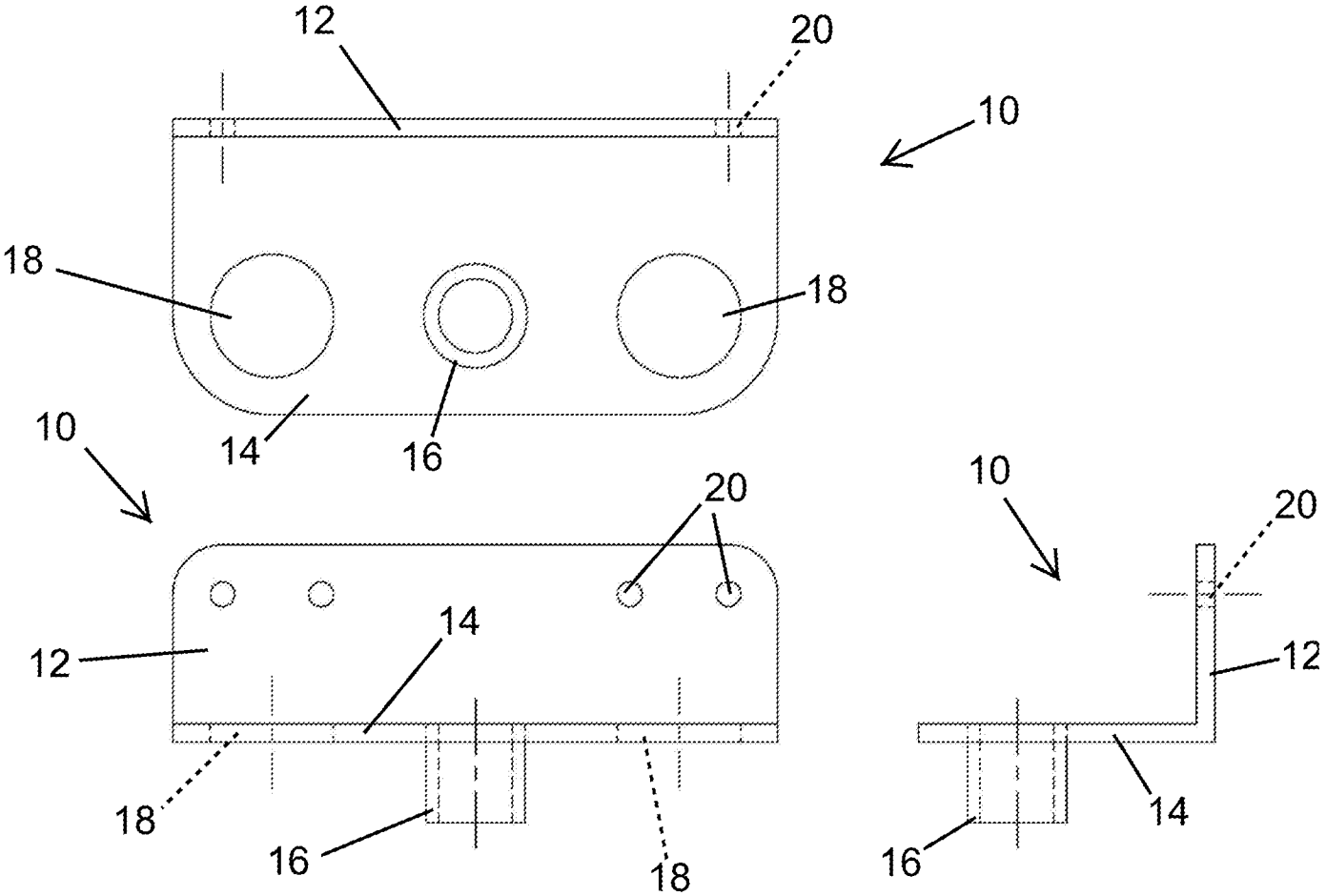
FIG. 1 schematically represents top, front, and side views of a mounting device for securing or supporting a wall-mounted sink to a structure in accordance with a first nonlimiting embodiment of this invention.

The present invention provides methods, systems, and hardware that utilize a mounting device for securing a wall-mounted sink to ameliorate if not eliminate inherent issues with existing support systems for wall-mounted sinks. The device, of which there are multiple embodiments shown in the drawings, counteracts and distributes forces that act to pull and possibly completely separate a wall-mounted sink from its mounting structure by providing a different and in some cases an additional attachment location that is at or adjacent an upper extremity of a wall-mounted sink. In preferred embodiments, the mounting device interlocks with hardware of a faucet intended to be installed on the sink, and may optionally be used in combination with conventional undermount sink supports, such as brackets, hangers, bolts, etc. Alternatively, the mounting device may be integrated into a wall-mounted sink, a faucet to be mounted on a wall-mounted sink, or a support structure of a wall-mounted sink, such that the device is inseparable therefrom without damaging the sink, faucet, or support structure. By securing a wall-mounted sink at or adjacent an upper extremity thereof, the mounting device is able to at least inhibit and preferably prevents the sink from pulling away the wall to which it is mounted or falling off a support that secures the sink to a wall.

While the following description will refer to wall-mounted sinks and mounting a sink to a wall, it should be understood that the term "wall" is meant to encompass essentially any substantially vertically-oriented mounting structure to which a sink may be mounted.

Features of the invention summarized above will now be described in reference to the drawings, which illustrate certain aspects of methods, systems, and hardware encompassed by the invention. However, it will be understood that such drawings depict nonlimiting embodiments of the invention and, therefore, are not to be considered as limiting its scope with regard to other embodiments which the invention is capable of contemplating.

FIG. 1 schematically represents top, front, and side views of a nonlimiting embodiment of a mounting device 10 having an "L" shaped configuration when viewed from the side. The illustrated embodiment of the device 10 has a first (upper) flange 12 configured and adapted for mounting to a wall, and a second (lower) flange 14 extending from the upper flange 12, oriented approximately perpendicular to the upper flange 12, and configured and adapted for mounting to a sink. Though single upper and lower flanges 12 and 14 are shown, it is foreseeable that the device 10 could comprise multiple upper and lower flanges 12 and 14. The lower flange 14 of the device 10 shown in FIG. 1 comprises a center piece 16 having a cylindrical or tubular configuration and protruding downward from the flange 14. The center piece 16 is an optional feature configured for interlocking the device 10 to a wall-mounted sink, optionally in combination with a conventional undermount sink support of the sink. The center piece 16 is shown as having a tubular shape, though the center piece 16 could be a solid cylinder without any passage through it. The center piece 16 is sized to enable it to be inserted into an opening in a wall-mounted sink, such as a hole conventionally provided in a sink for installing a faucet. The lower flange 14 of the device 10 further comprises side holes 18 that are located to align with openings conventionally provided in a sink to provide access for mounting a faucet and through which pipes or other conduits pass to supply water to the faucet. The upper flange 12 of the device 10 comprises multiple holes 20 through which any suitable type of anchors can be installed to attach the device 10 to a wall.

Figure 2:
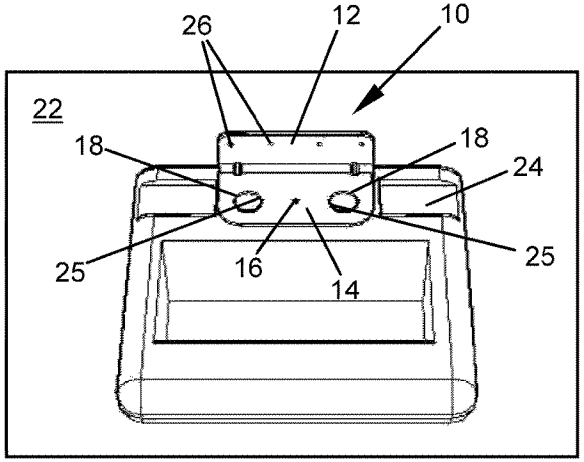
FIG. 2 is an image showing the mounting device of FIG. 1 securing a sink to a wall in accordance with a nonlimiting aspect of the invention.
Figure 4:
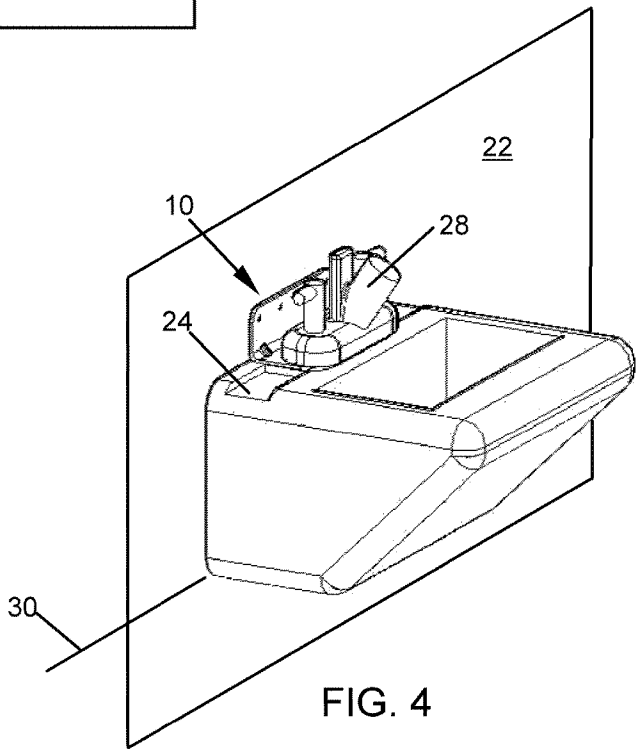
FIGS. 3 and 4 represent the sink and mounting device of FIGS. 1 and 2 after installation of a faucet on the sink.
Figure 3:
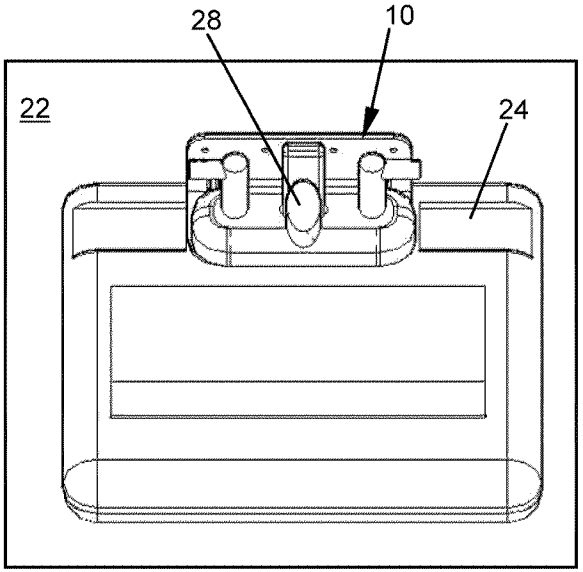

FIG. 2 shows a top perspective view of the mounting device 10 of FIG. 1 mounted to a wall 22 with anchors 26 and interlocking a wall-mounted sink 24 to the wall 22 at an upper extremity (edge or surface) of the sink 24. The sink 24 is represented as having three faucet-mounting holes 25 (two of which are visible), and the center piece 16 of the device 10 is shown inserted into the center hole 25 (not visible) of the three holes 25. The center piece 16 of the device 10 is preferably sized to provide minimal clearance with the center hole 25 of the sink 24. The device 10 attaches and supports the sink 24 to the wall 16 above the pivot axis of the sink 24 (defined by a lower edge or surface of the sink 24). In FIG. 2, the device 10 may supplement an undermount sink support (not shown) to interlock the sink 24 securely and tightly against the wall 22. FIGS. 3 and 4 are images showing a faucet 28 installed on the device 10 by further using the holes 25 of the sink 24, the holes 18 of the device 10 (aligned with the holes 25), and plumbing and hardware (not shown) of the faucet 28 that pass through the aligned holes 18 and 25. A pivot axis 30 of the sink 24 is identified in FIG. 4.

Figure 5:
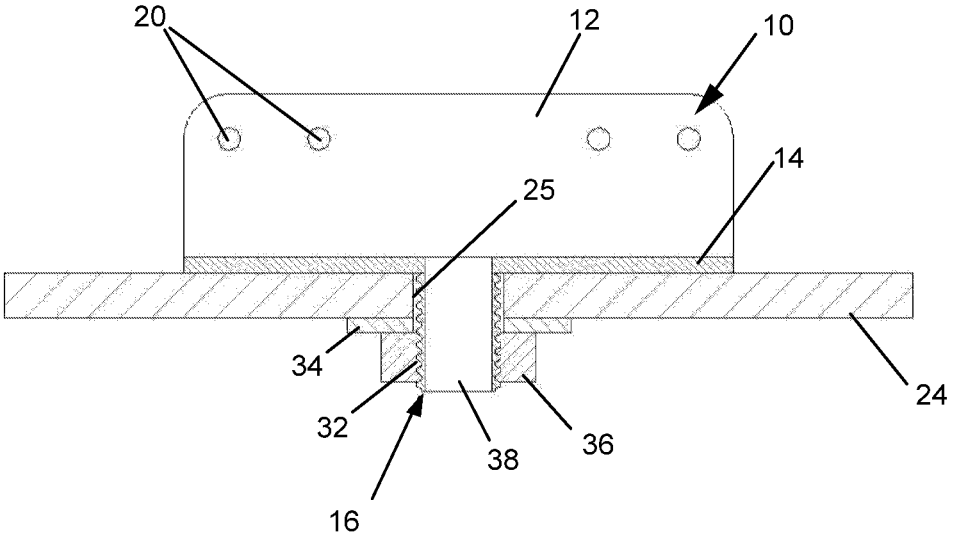
FIGS. 5 and 6 schematically represent front cross-sectional views of mounting devices for securing or supporting a wall-mounted sink to a structure in accordance with second and third nonlimiting embodiments of this invention.

FIG. 5 schematically represents another embodiment of the device 10 configured for use with a wall-mounted sink 24 that has a single faucet-mounting hole 25. An upper extremity (edge or surface) of the sink 24 is positioned beneath the lower flange 14 of the device 10. The center piece 16 of the device 10 is represented as a tube having threads 32 on its exterior, and the device 10 further includes a washer 34 and nut 36 to secure the device 10 to the sink 24. Water flowing to a faucet (not shown) mounted to the sink 24 would flow through the interior passage 38 of the center piece 16.

Figure 6:
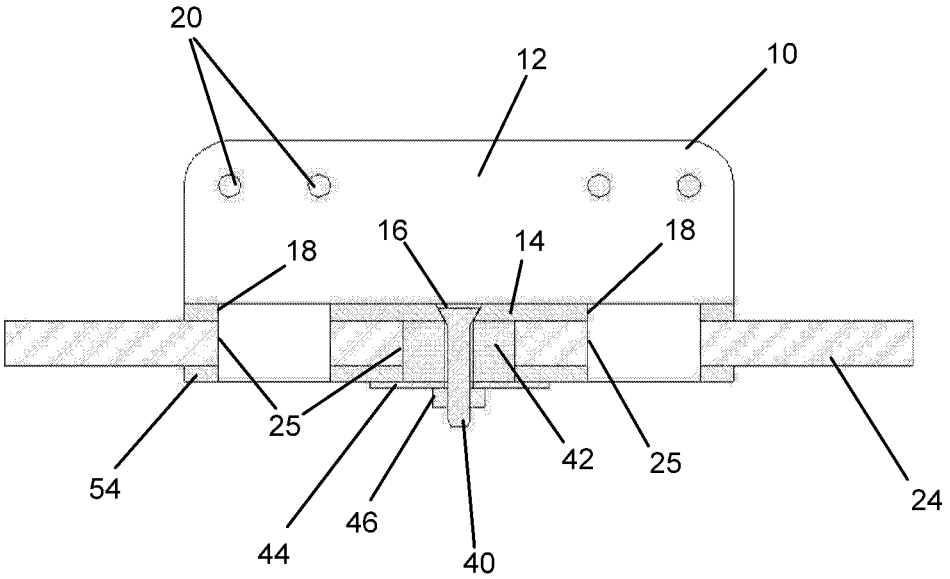
Figure 8:
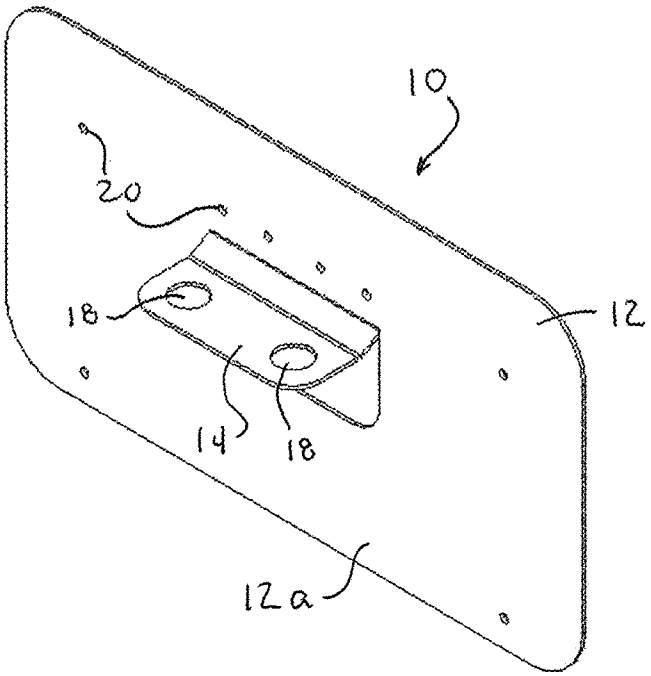
FIGS. 7 through 10 and FIGS. 11 through 14 schematically represent various views of mounting devices for securing or supporting a wall-mounted sink to a structure in accordance with fourth and fifth nonlimiting embodiments of this invention.
Figure 7:
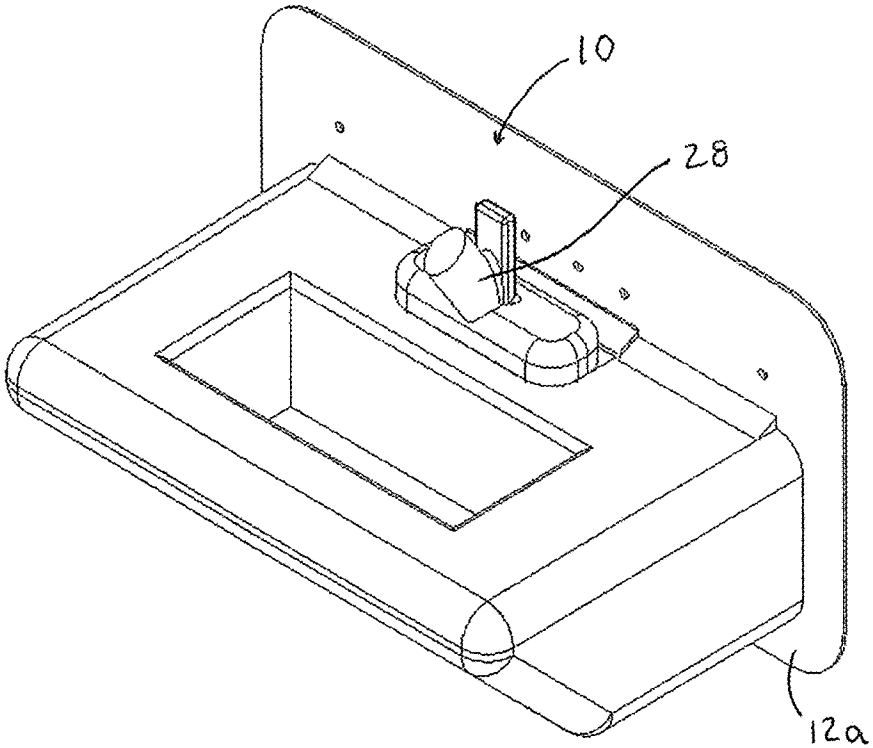
Figure 9:
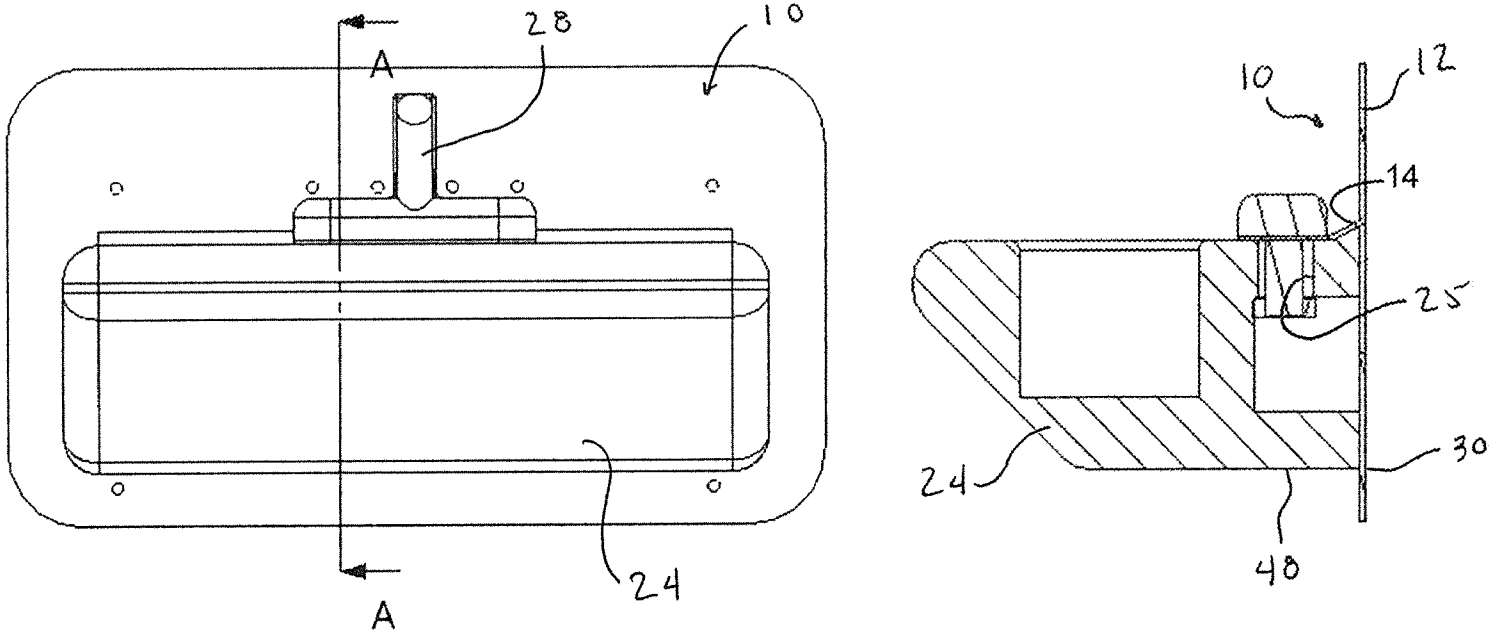
Figure 10:
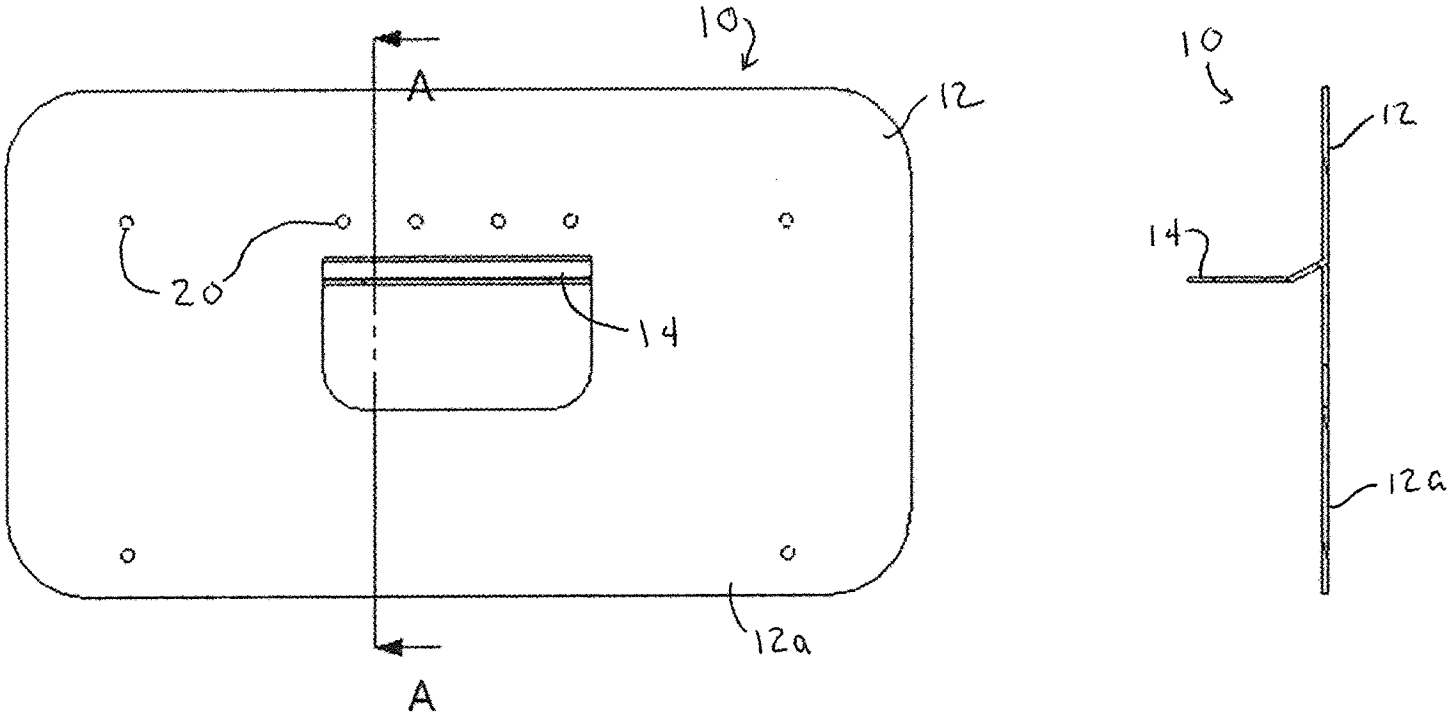

FIG. 6 schematically represents another embodiment of the mounting device 10 configured for use with a wall-mounted sink 24 having three faucet-mounting holes 25. Instead of having a cylindrical or tubular configuration protruding from the lower flange 14, the center piece 16 of the device 10 is configured as a countersink hole sized for receiving a screw 40. The device 10 further comprises a rubber cylinder 42 placed in the center faucet-mounting hole 25 of the sink 24. In combination with a washer 44 and nut 46, the screw 40 is operable to compress the rubber cylinder 42 against the lower flange 14 of the device 10 and expand the cylinder 42 against the wall of the center hole 25 to secure the device 10 to the sink 24. Water flowing to a faucet (not shown) mounted to the sink 24 would flow through the holes 18 of the device 10 aligned with the two outer holes 25 of the sink 24. FIG. 6 further shows a nonlimiting example of the device 10 being used in combination with (and therefore as a supplement to) a conventional undermount sink support (bracket) 54. In this embodiment, a portion of the sink 24 is clamped between the undermount sink support 54 and the lower flange 14 of the device 10, thereby interlocking the sink 24 securely and tightly against the wall 22. Alternatively, the device 10 can be secured to the sink 24 in a manner similar to that represented FIG. 5.

FIGS. 7 through 10 schematically represent another embodiment of the mounting device 10 whose upper flange 12 is much larger than in previous embodiments to provide an integrated backsplash for a sink 24, which as illustrated lacks a raised rim. The upper flange 12 is sized such that a portion 12*a* thereof extends below the lower flange 14, which is shown as lacking the center pieces 16 of previous embodiments. The larger size of the integrated backsplash allows the holes 20 in the upper flange 12 to be more widely spaced, enabling the device 10 to be attached to multiple studs of a wall (not shown). The device 10 is secured by positioning the upper extremity (edge or surface) of the sink 24 beneath the lower flange 14, aligning the holes 18 in its lower flange 14 with the faucet-mounting holes 25 (FIG. 9) of the sink 24, and securing the sink 24 to the faucet 28 with the faucet hardware. In addition, the sink 24 abuts the portion 12*a* of the flange 12 that extends below the lower flange 14, such that the pivot axis 30 of the sink 24 is located where the lower edge 48 of the sink 24 abuts the portion 12*a* of the flange 12. For additional support, the sink 24 can be secured to the device 10 or wall with an undermount sink support, as a nonlimiting example, similar to the support 54 shown in FIG. 6.

Figure 12:
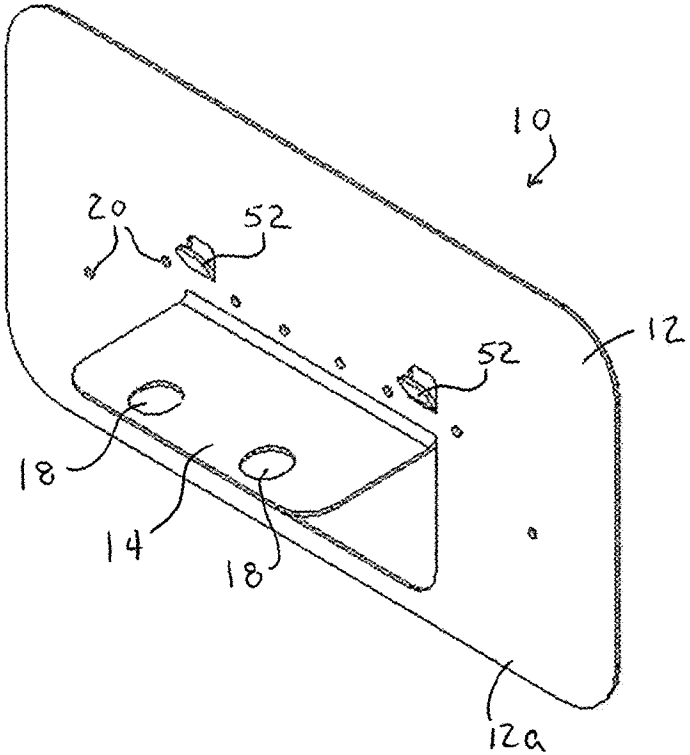
Figure 11:
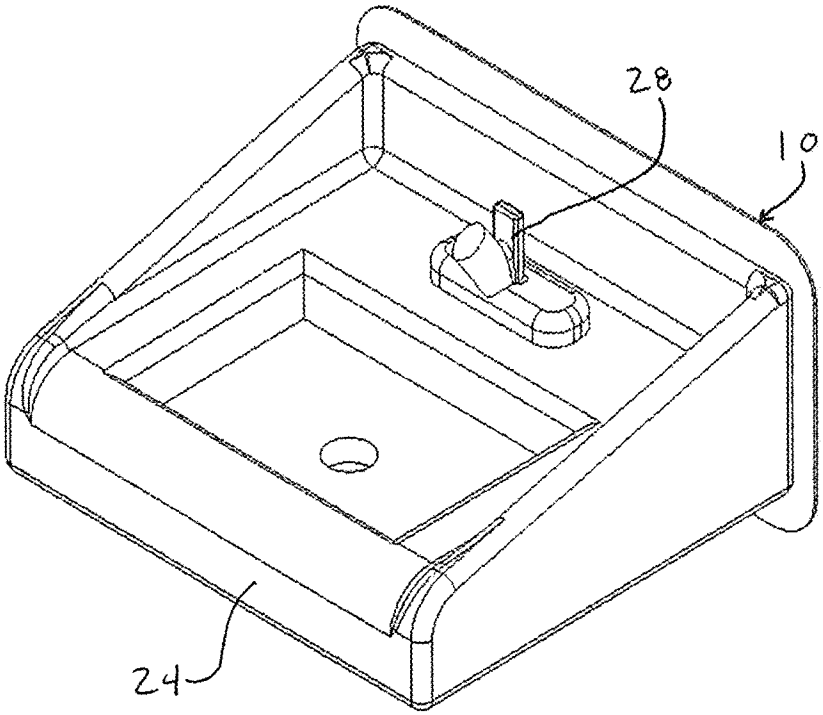
Figure 13:
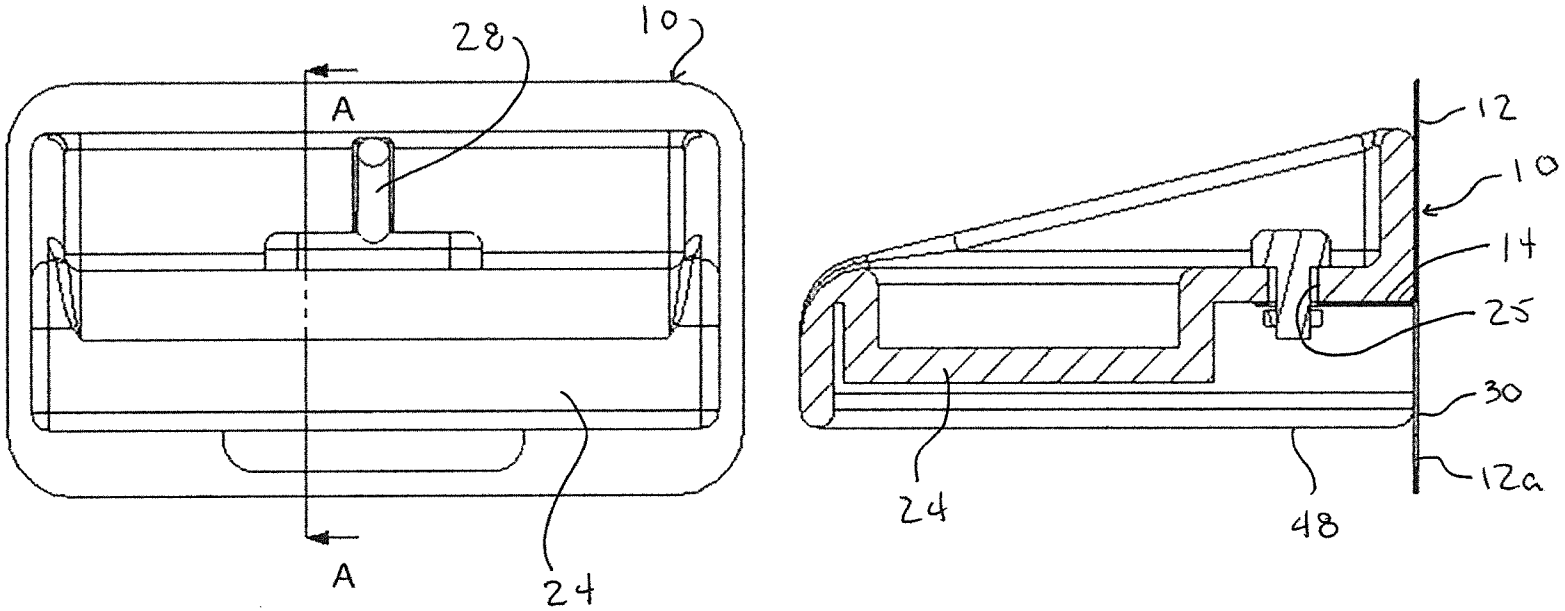
Figure 14:
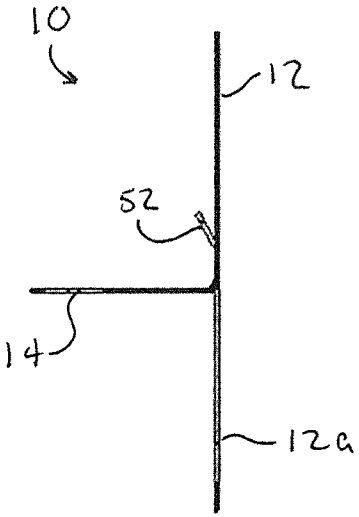
Figure 14:
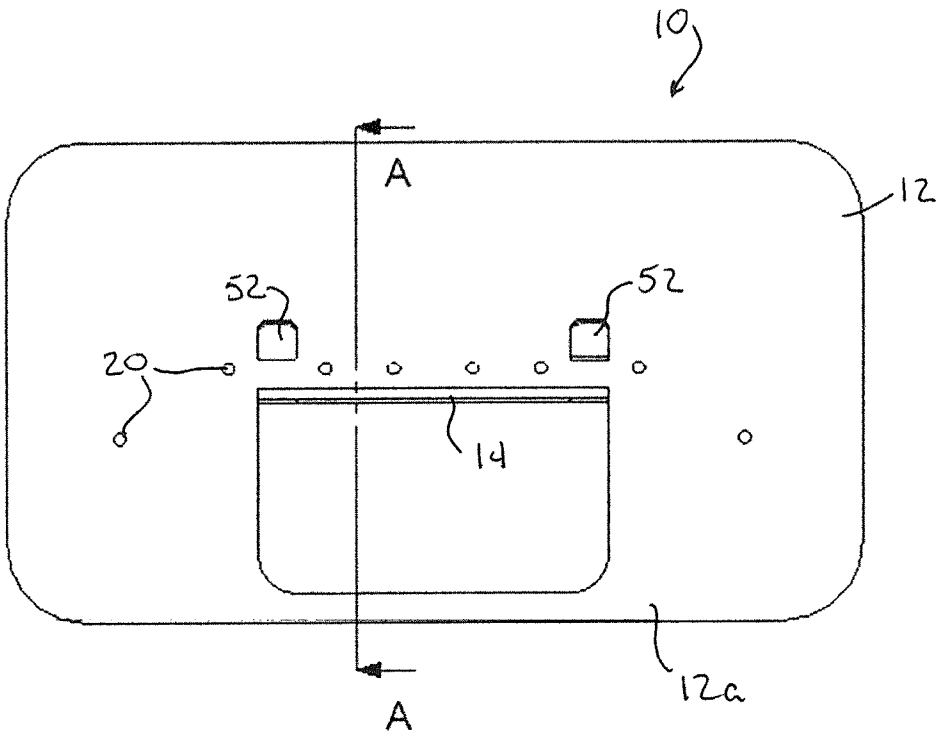

FIGS. 11 through 14 schematically represent yet another embodiment of the mounting device 10 whose upper flange 12 defines an integrated backsplash for the sink 24, which in FIGS. 11 and 14 is shown as having a raised rim. The device 10 has integrated tabs 52 for mounting the sink 24 and providing additional support above the pivot axis 30. As seen in FIGS. 12 and 14, the tabs 52 are located in the upper flange 12 above the lower flange 14, and are configured for engaging the sink 24 to serve with the lower flange 14 as means for interlocking the device 10 with the sink 24. As best seen in FIGS. 12 and 14, the lower flange 14 has an outermost extent that is farther from the upper flange 12 than the tabs 52 are from the lower flange 14, and the tabs 52 are located closer to the lower flange 14 than to an uppermost extent of the upper flange 12. In contrast to the embodiments of FIGS. 2 through 10, the lower flange 14 of the device 10 is positioned beneath a portion of the sink 24 (FIG. 13), such that the flange 14 is positioned adjacent but not at the upper extremity (edge or surface) of the sink 24, between the tabs 52 and the pivot axis 30, and supports a portion of the sink 24 surrounding its faucet-mounting holes 25. The sink 24 is secured by aligning its faucet-mounting holes 25 with the holes 18 in the lower flange 14 of the device 10. Alternatively, the device 10 can be secured to the sink 24 in a manner similar to that represented FIG. 5 or 6. The sink 24 abuts the portion 12*a* of the flange 12 that extends below the lower flange 14, such that the pivot axis 30 of the sink 24 is located where the lower edge 48 of the sink 24 abuts the portion 12*a* of the flange 12.

The embodiments of the mounting device 10 described above and shown in the drawings may further comprise one or more gaskets (not shown) that can be placed between the device 10 and the sink 24 and/or faucet 28 to protect the sink 24 and/or faucet 28 from being damaged by the device 10. The device 10 may also further comprise spacers (not shown) that can be placed between the sink 24 and wall 22 to address any gaps therebetween. The device 10 may optionally have a decorative upper surface or further comprise a decorative cover (not shown) for enhancing its appearance.

While the invention has been described in terms of specific or particular embodiments, it should be apparent that alternatives could be adopted by one skilled in the art. For example, the device 10 and its components could differ in appearance and construction from the embodiments described herein and shown in the drawings, functions of certain components of the device 10 could be performed by components of different construction but capable of a similar (though not necessarily equivalent) function, and various materials could be used in the fabrication of the device and/or its components. As such, it should be understood that the above detailed description is intended to describe the particular embodiments represented in the drawings and certain but not necessarily all features and aspects thereof, and to identify certain but not necessarily all alternatives to the represented embodiments and described features and aspects. As a nonlimiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings. It should also be understood that the phraseology and terminology employed above are for the purpose of describing the illustrated embodiments, and do not necessarily serve as limitations to the scope of the invention. Therefore, the scope of the invention is to be limited only by the following claims.

The invention claimed is:

1. A device in combination with a wall-mounted sink having an upper portion, an upper extremity, and a lower extent, the device securing or supporting the wall-mounted sink to a mounting structure, the device comprising:

a first flange configured and adapted for securement to the mounting structure, the first flange having an upper portion, a lower portion, and means located in the upper portion for attaching the first flange to the mounting structure, the upper and lower portions being arranged so that the upper and lower portions abut the mounting structure;

a second flange extending from the first flange and secured to the sink, the second flange adjoining the first flange between the upper and lower portions thereof and being configured relative to the first flange so that the second flange is mounted below the upper extremity of the sink, the upper portion of the sink abuts the upper portion of the first flange and the lower extent of the sink contacts the lower portion of the first flange to define a pivot axis of the sink that is below the second flange;

means for interlocking the second flange with the sink;

tabs that are located on the first flange above the pivot point and engaging the sink; and an integrated backsplash.

2. The device of claim 1, wherein the interlocking means comprises at least one hole in the second flange of the device that is aligned with a faucet-mounting hole in the sink.

3. The device of claim 1, wherein the interlocking means comprises faucet-mounting hardware that secures the sink and a faucet mounted to the sink to the device.

4. The device of claim 1, wherein the tabs are located in the upper portion of the first flange and engage the upper portion of the sink.

5. The device of claim 1, wherein the second flange has an outermost extent that is farther from the first flange than the tabs are from the second flange.

6. The device of claim 1, wherein the attaching means comprises holes adapted and configured to secure the first flange to wall studs of the mounting structure.

7. A device in combination with a wall-mounted sink having an upper portion, an upper extremity, and a lower extent, the device securing or supporting the wall-mounted sink to a mounting structure, the device comprising:

a first flange configured and adapted for securement to the mounting structure, the first flange having an upper portion, a lower portion, and means located in the upper portion for attaching the first flange to the mounting structure, the upper and lower portions being arranged so that the upper and lower portions abut the mounting structure;

a second flange extending from the first flange and secured to the sink, the second flange adjoining the first flange between the upper and lower portions thereof and being configured relative to the first flange so that the second flange is mounted below the upper extremity of the sink, the upper portion of the sink abuts the upper portion of the first flange and the lower extent of the sink contacts the lower portion of the first flange to define a pivot axis of the sink that is below the second flange;

means for interlocking the second flange with the sink;

tabs that are attached to the first flange and above the pivot point and are configured for engaging the sink, the second flange having an outermost extent that is farther from the first flange than the tabs are from the first flange, and the tabs being located closer to the second flange than to an uppermost extent of the first flange.

8. The device of claim 7, wherein the device further comprises of an integrated backsplash.

9. A device mounted to a mounting structure and securing or supporting a wall-mounted sink to the mounting structure, the wall-mounted sink having an upper portion, faucet-mounting holes, and a lower extent, the device comprising:

a first flange secured to the mounting structure, the first flange having an upper portion, a lower portion, and means located in the upper portion for attaching the first flange to the mounting structure so that the upper and lower portions abut the mounting structure, the first flange defining a backsplash extending above the sink;

a second flange extending from the first flange and supporting a portion of the sink surrounding the faucet-mounting holes of the sink, the second flange adjoining the first flange between the upper and lower portions thereof and being configured relative to the first flange so that the upper portion of the sink abuts the upper portion of the first flange and the lower extent of the sink contacts the lower portion of the first flange to define a pivot axis of the sink that is below the second flange;

means for interlocking the device with the sink, the interlocking means comprising the second flange and tabs located on the first flange above the pivot point and engaging the sink, the second flange having an outermost extent that is farther from the first flange than the tabs extend from the first flange, and the tabs being located closer to the second flange than to an uppermost extent of the first flange.

10. A method of using the device of claim 9 to secure or support the sink to the mounting structure, the method comprising securing the first flange to the mounting structure and the second flange to the sink below a portion of the sink surrounding the faucet-mounting holes of the sink so that the device is located above the pivot axis of the sink.

* * * * *